United States Patent [19]

Ganter et al.

[11] 4,143,507

[45] Mar. 13, 1979

[54] BATTERY OPERATED ELECTRONIC WATCH

[75] Inventors: Wolfgang Ganter, Schramberg; Albert Ginter, Lauterbach, both of Fed. Rep. of Germany

[73] Assignee: Firma Gebruder Junghans GmbH, Schramberg, Fed. Rep. of Germany

[21] Appl. No.: 814,088

[22] Filed: Jul. 8, 1977

[30] Foreign Application Priority Data

Jul. 17, 1976 [DE] Fed. Rep. of Germany ..... 2632303

[51] Int. Cl.[2] ..... G04B 19/24; G04B 27/00; G04C 3/00

[52] U.S. Cl. ..... 58/4 A; 58/23 BA; 58/23 D; 58/58; 58/85.5

[58] Field of Search ..... 58/4 R, 4 A, 23 R, 23 BA, 58/23 D, 57, 58, 85.5, 88 R, 104

[56] References Cited

U.S. PATENT DOCUMENTS 3,628,324 12/1971 Chopard et al. ..... 58/23 D 3,969,642 7/1976 Yoshino ..... 58/23 D X 3,986,335 10/1976 Harper ..... 58/23 R X

*Primary Examiner*—Stanley J. Witkowski

*Attorney, Agent, or Firm*—Burns, Doane, Swecker & Mathis

[57] ABSTRACT

A battery operated watch includes an actuator mechanism adapted to actuating indicator hands of the watch. The actuating mechanism includes a gear train adapted to drive indicator hands, a motor for driving the gear train, and an electronic block unit. The electronic block unit includes an oscillator and electronic circuit for operating the motor. A mechanism plate and bridge are provided. A carrier plate of insulative material is disposed between the mechanism plate and bridge. The carrier plate has pockets, including indentations, bores and openings, for receiving and retaining in position at least some components of the actuating mechanism. Means is provided for securing the mechanism plate, bridge, and carrier plate together, including a plurality of pillars extending between the mechanism plate and the bridge.

11 Claims, 6 Drawing Figures

FIG. 1
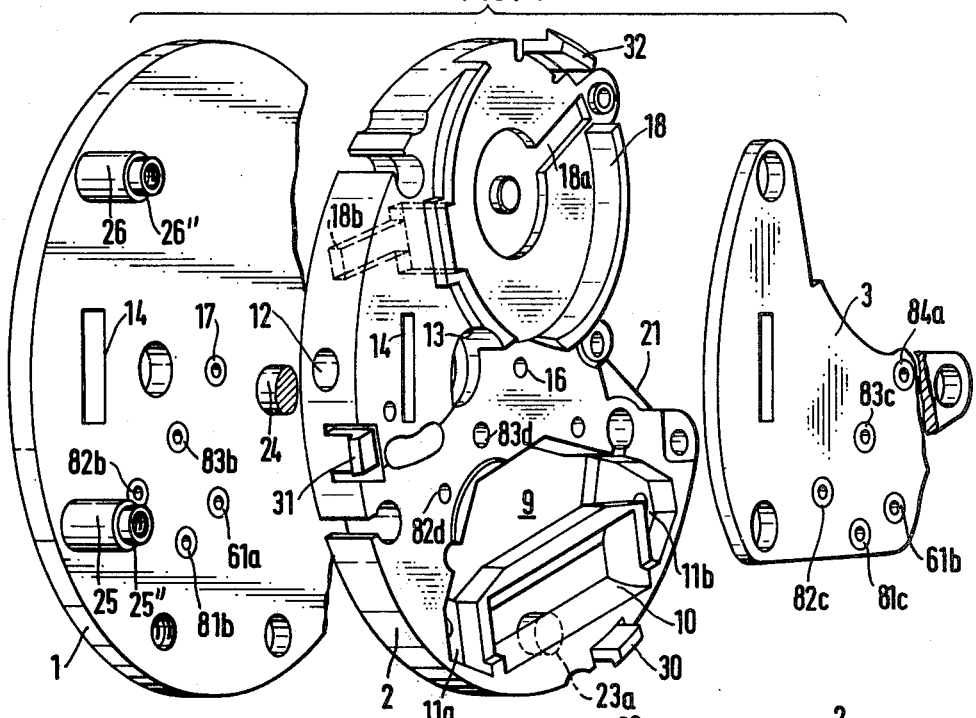
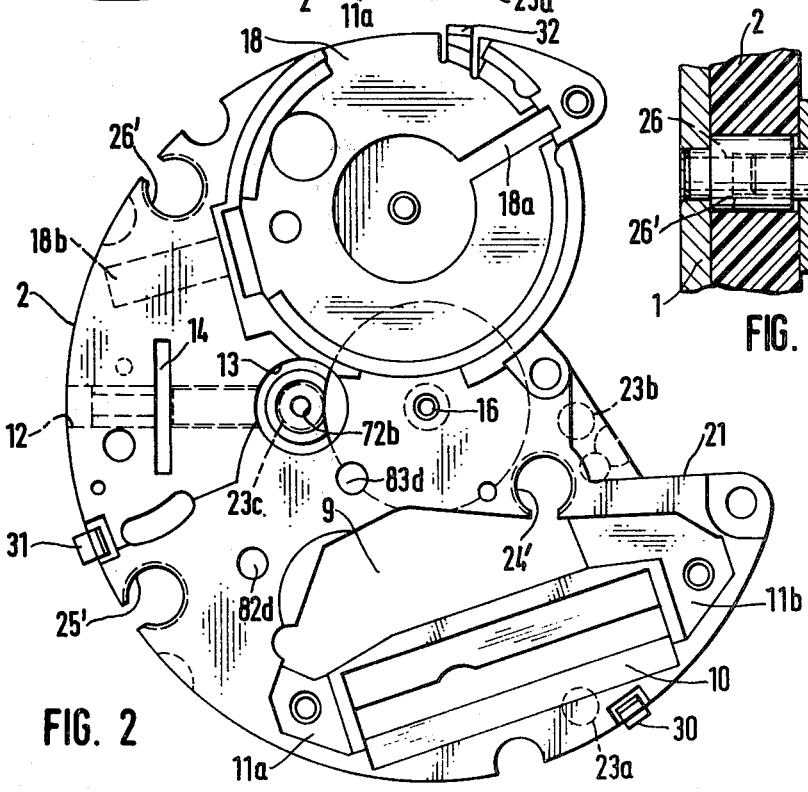
FIG. 2
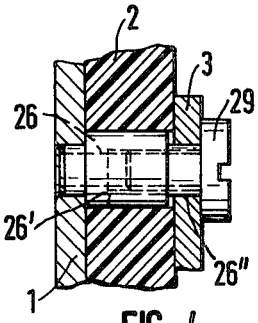
FIG. 4

BATTERY OPERATED ELECTRONIC WATCH

BACKGROUND AND OBJECTS

The invention relates to a battery operated electronic watch. Such watches, especially a quartz-crystal wrist watch, have a watch mechanism with an electronic module, combined into a construction unit on a carrier of insulating material with a frequency standard and an electronic circuit for the time-keeping control of a watch drive with a subordinated hands-driving gear train which is disposed between a mechanism plate and at least one bridge.

Such a watch is known for example from German AS 21 31 476. The carrier is made of plastic, and is developed as a shaped piece provided with chambers. Within these chambers all electronic construction units, such as a quartz-crystal oscillator, a frequency adjusting arrangement, a temperature compensation device and an oscillator, frequency divider and driving circuit for the drive of an electromechanical converter are stored. The remaining construction units of the watch, namely the gear train and dial train, as well as a motor are disposed in the watch in the traditional manner.

Moreover, a watch mechanism has become known through German patent 19 01 961, in case of which an intermediate plate, which serves at the same time as a support for a few penetrating shafts during assembly is disposed between a mounting plate and a bridge.

Both arrangements mentioned above are based on the object of simplifying the mounting of very special individual parts of the watch or watch mechanism.

As compared to that, the object of the present invention is to provide an electronic watch the mechanism of which may be produced at less cost by saving or reducing hiterto necessary finishing, mounting and aligning operations.

BRIEF DESCRIPTION

In accordance with the present invention, a battery operated watch includes an actuator mechanism adapted to actuating indicator hands of the watch. The actuating mechanism includes a gear train adapted to drive indicator hands, a motor for driving the gear train, and an electronic block unit. The electronic block unit includes an oscillator and electronic circuit for operating the motor. A mechanism plate and bridge are provided. A carrier plate of insulative material is disposed between the mechanism plate and bridge. The carrier plate has pockets, including indentations, bores and openings, for receiving and retaining in position at least some components of the actuating mechanism. Means is provided for securing the mechanism plate, bridge, and carrier plate together, including a plurality of pillars extending between the mechanism plate and the bridge.

THE DRAWINGS

A preferred embodiment of the invention is explained subsequently in more detail on the basis of the drawings in which:

FIG. 1 is an exploded, perspective view of a mechanism plate, a carrier plate and a bridge according to the present invention, FIG. 2 is a view of the carrier plate in a direction facing the housing bottom, prior to assembly of parts therein, FIG. 3 is a view similar to FIG. 2 when the parts are assembled, FIG. 4 is an enlarged sectional view of the connection of the mechanism plate, carrier plate and bridge taken along the line IV—IV in FIG. 3, FIGS. 5*a* and 5*b* are enlarged cross-sectional views taken along lines Va—Va and Vb—Vb, respectively in FIG. 3.

DETAILED DESCRIPTION OF A PREFERRED EMBODIMENT

Figure 3:
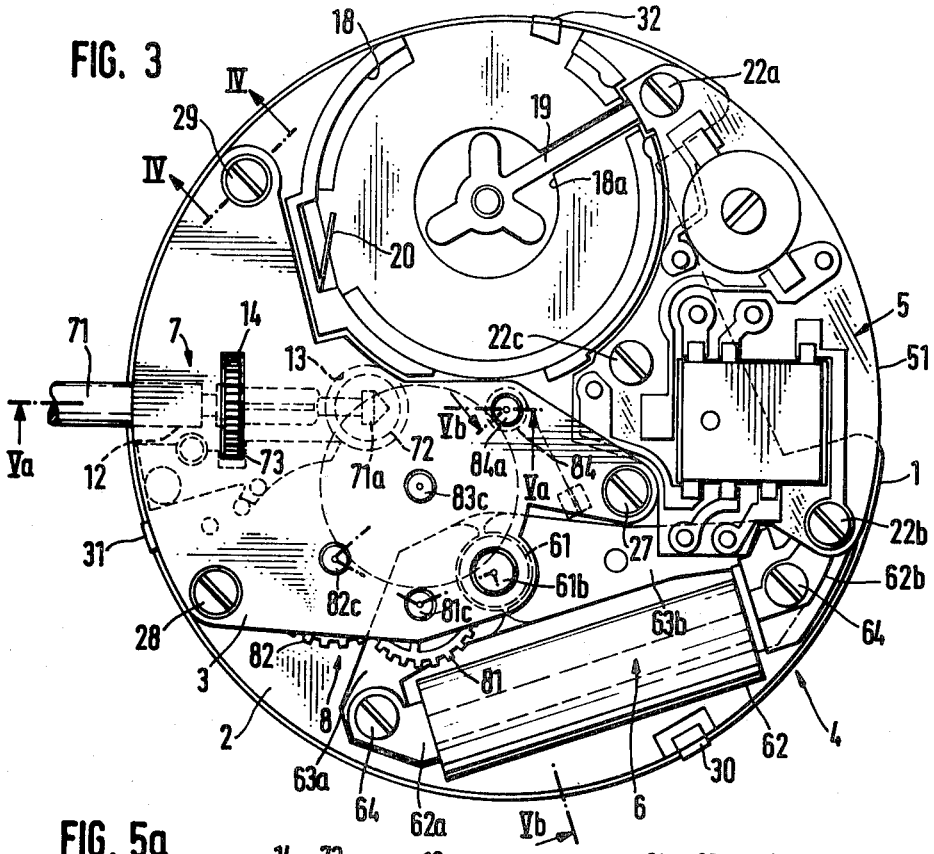
Figure 5A:
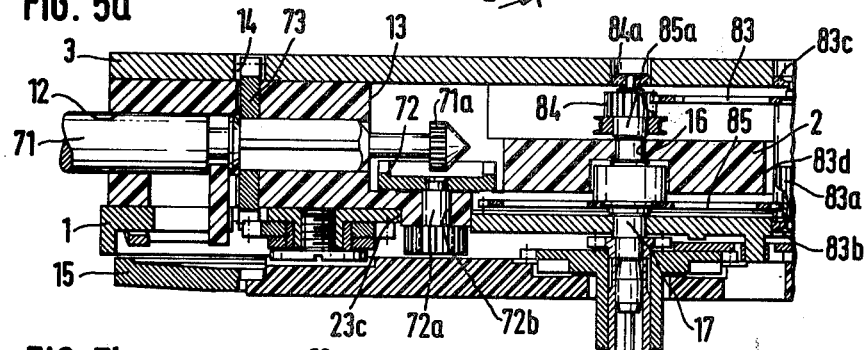
Figure 5B:
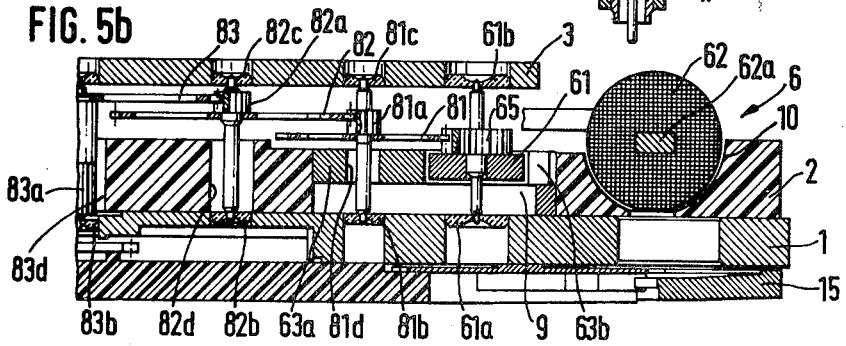

In the figures, 1 designates a mechanism or base plate, 2 a carrier plate and 3 a bridge, which parts form the frame of a watch mechanism 4 of a battery operated electronic quartz-crystal wrist watch. Concerning the parts of the watch movement 4 shown in FIGS. 1, 3, 5*a* and 5*b*, for the sake of clarity, only those parts are illustrated which are needed for understanding the invention.

The mechanism plate 1 and the bridge 3 consist of metal. Both the plate 1 and the bridge 3 fit against opposite surfaces of the carrier plate 2, so that their spacing and thus the width of the frame of watch movement 4 is determined by the thickness of the carrier plate 2. The latter comprises plastic, chiefly temperature resistant and dimensionally stable plastic, and is preferably produced by a single injection molding process.

The carrier plate 2 has a large number of pockets in the form of bores, indentations and breaches for the positionally fixed arrangement or mounting of at least a large part of the mechanical and electronic parts for the operation of the watch. These parts include an electronics block 5, a battery (not shown), several parts of the motor 6 forming the drive for the watch, and an arrangement 7 for the setting of the hands, and the gear train 8.

In detail the carrier plate 2 has an opening 9, within which a rotor 61 of the motor 6 is disposed. The rotor 61 is mounted rotatably in a bearing 61*a* disposed in the mechanism plate 1 and in a bearing 61*b* in the bridge 3. Located adjacent the opening 9 are a sub-shaped indentation 10 for the reception of a motor coil 62, and a pair of indentations 11*a* and 11*b* disposed on both sides of the indentation 10. Each indentation 11*a*, 11*b* receives one of the stator laminations 63*a* and 63*b*, disposed at both sides of the rotor 61. The cross-sectional surfaces of the indentations 11*a* and 11*b* and of the breach 9 are adapted to the cross-sectional surfaces of the two stator laminations 63*a* and 63*b* in such a way, that their position in relation to the rotor 61 and the geometry of the air gap is positively fixed without additional adjusting measures. The motor coil 62 and the two stator laminations 63*a* and 63*b* are attached to the mechanism plate 1 by means of two screws 64. For this, bores have been made in the stator laminations and axially aligned thereto in an iron core 62*a* projecting laterally from the motor coil 62, and in a connecting plate 62*b* for coils, by the screws 64.

The carrier plate 2 serves moreover for the reception of various individual parts of the adjusting arrangement 7, for the hands. Accordingly, a radial bore 12 has been molded into the carrier plate 2, which serves as a bearing for an adjusting shaft 71 for the hands. The shaft is both longitudinally shiftable and rotatable by outside manual action. The bore 12 leads into an indentation 13, in which an adjusting gear 72 for the hands is seated, which gear 72 may be coupled with the adjusting shaft 71 by a pinion 71*a* disposed thereon. This adjusting gear 72 for the hands is mounted rotatably via a bearing shaft 72*a* in a bore 72*b* in the carrier plate 2. Furthermore, an additional opening 14 is provided in the carrier plate which has mutually parallel inside surfaces disposed perpendicularly to the radial bore 12. The opening 14 is continued with the same cross-section in the mechanism plate 1 and the bridge 3. Within the spatial extent of this breach 14, an adjusting wheel 73 is disposed for the shifting of a date-ring 15. The wheel 73 sits on the adjusting shaft 71 with little axial play being permitted by the inside surfaces of the opening 14, and which may be driven thereby.

The time driving gear train 8 consists of an intermediate gear 81 intermeshing with a motor pinion 65 seated on the rotor 61. The drive pinion 81*a* of gear 81 meshes with a seconds gear 82. The drive pinion 82*a* of the latter meshes with a small bottom gear 83. The gear 83 is in driving connection with a central seconds drive pinion 84 and the drive pinion 83*a* of the gear 83 is in driving connection with a minute gear 85. The intermediate gear 81 is mounted rotatably in a bearing 81*b* in the mechanism plate 1 and in a bearing 81*c* in the bridge 3. A bearing 82*b* in the mechanism plate 1 and a bearing 82*c* in the bridge 3 have been provided for the mounting of the seconds gear 82. The small bottom gear 83 is seated between a bearing 83*b* in the mechanism plate 1 and a bearing 83*c* in the bridge 3. For the mounting of the minutes gear 85, there is provided firstly a bore 16 in the carrier plate 2. Into this bore a bearing bushing 85*a* is inserted nonpositively, which bushing forms the rear minutes gear bearing as well as the forward bearing for the central seconds drive pinion 84. The drive pinion 84 is also mounted in a bearing 84*a* in the bridge 3. For mounting the minutes gear 85 there is further provided a bearing bushing 17 inserted in a bore in the mechanism plate 1, aligned axially with the bore 16, which bushing 17 forms the forward minutes gear bearing. The axles of the gears 82 and 83 are guided through bores 82*d* and 83*d* in the carrier plate, and the axle of the intermediate gear 81 is guided through a bore 81*d* penetrating the stator laminations 63*a*.

In the carrier plate 2, an indentation 18 is provided for the reception of a battery (not shown for the sake of clarity) which indentation 18 is largely adapted in its outside shape to the battery. Within this indentation 18 there are disposed molded-in cavities 18*a* and 18*b*, in which contact lugs 19 and 20 have been disposed. These lugs 19, 20 serve on the one hand for an electric connection of the battery with the electronic block 5 and the mass (mechanism plate 1), and on the other hand for holding the battery within the indentation 18.

All parts of the electronic block 5 for the drive of the motor 6 are attached on a bilaterally printed conductive plate 51. These parts include a quartz-crystal oscillator, a frequency adjusting arrangement, and an electronic driving circuit in integrated technique. In order to make possible a mounting of different parts, especially of the quartz-crystal oscillator, within the spacial extent of the carrier plate 3, the plate 2 has an indentation 21 at an appropriate place (FIG. 2). The conductive plate 51, along with the complete electronic block 5, is attached by three screws 22*a*, 22*b* and 22*c* (FIG. 3) to the carrier plate 2. These screws are guided through associated bores of the carrier plate and engage with threads of the mechanism plate 1. The conductive plate 51 extends above the indentation 21 in its marginal area, such a way that the contact lug 19, which fits on the one hand against the negative terminal of the battery and on the other hand against the input terminal of the electronic block 5, is attached to the carrier plate 2 by the screw 22*a*. In addition, the conductive plate 51 extends above the coil connecting plate 62*b* in such a way, that the coil connections, disposed thereon, coincide with the corresponding output connections of the electronic block 5 and are kept in pressure contact by the screw 22*b*.

In order to orient the carrier plate 2 in relation to the mechanism plate 1, a pillar arrangement has been provided. This pillar arrangement comprises several fixing pins 23*a*, 23*b* and 23*c* (FIG. 5*a*), molded on to the carrier plate 2 which engage with corresponding bores in the mechanism plate 1, and of several fixing bolts 24, 25, 26, attached to the mechanism plate 1. The fixing bolts engage with corresponding bores 24', 25' and 26' of the carrier plate 2. One of these connections is shown in detail in FIG. 4. The fixing bolts 24–26, with their associated bores, form an interference or friction fit in such a way that the carrier plate 2, after being fitted together with the mechanism plate 1, is held by pressure contact in the fitted together position. Every fitting bolt also has at its outside end an extension bolt 24'', 25'' and 26'', which has a smaller diameter. These extension bolts project into corresponding bores of the bridge 3 and serve for the fixation of their position in relation to the mechanism plate and the carrier plate. The bridge 3 is attached to the carrier plate 2 by screws 27, 28 and 29, which engage with inside threads of the fixing bolts.

Integrally molded at the periphery of the carrier plate 2 are several radial, resilient holding claws 30, 31 and 32. These claws 30–31 engage with a groove of a watch housing (not shown) and make possible a simple assembly of the entire watch movement into the watch housing, without any further attaching measures. These holding claws 30, 31 and 32 are also shaped such that a simple removal of the entire watch mechanism from the housing is also possible at any time.

The gear train and hand adjusting mechanism 7 are connected to the indicator hands in conventional fashion, as demonstrated for example in the afore-mentioned German patent publications.

By the use of a plastic carrier plate which determines the width of the frame of the watch movement, which is disposed between a mechanism plate and a bridge, and which may be produced by one single injection molding process, all hitherto necessary drilling and milling processes, at least on the side of the mechanism plate facing the bridge, are eliminated. Moreover, the mechanism plate, because of its considerably lesser thickness may now be formed by stamping. The carrier plate itself serves for the reception and mounting of almost all construction units needed for the operation of the watch, including a battery. These units are fixed in position in corresponding bores, indentations and breaches in such a way that no further adjusting measures are needed. Beyond that, the correct orientation and attachment of the carrier plate on the mechanism plate, and a simple final assembly or dismantling of the entire watch mechanism in a watch housing is provided by holding claws molded onto the periphery of the carrier plate. Thus production costs, which are considerably lower in comparison to traditionally produced watches, are possible as a result of these previously described measures.

In conclusion, it should be pointed out that the invention is not limited to what has been shown in the figures and described in the preceding paragraphs but that other arrangements of the individual parts of the watch mechanism within the scope of the invention and maintaining the construction principle of the invention, e.g., different structures of the carrier plate or the mechanism plate, are possible.

What is claimed is:

1. A battery operated watch comprising
a one-piece base plate;
a one-piece bridge;
a one-piece carrier plate formed of insulative material disposed between said base plate and said bridge;
said base plate and said bridge engaging opposing surfaces of said carrier plate so that the spacing between said base plate and said bridge is determined by the thickness of the carrier plate;
actuating means adapted to activate indicator hands of the watch, said actuating means comprising:
a motor mounted in a first pocket in said carrier plate,
an electronic block unit mounted in a second pocket in said carrier plate and including an oscillator and electronic circuit for operating said motor,
a gear train arranged to drive the indicator hands, said gear train being driven by said motor and including a plurality of intermeshing gears mounted on axles, said axles each including first and second ends rotatably mounted in said bridge and base plate, respectively, said axles passing through openings in said carrier plate, and
means for securing said base plate, bridge, said carrier plate together including a plurality of pillars extending between said base plate and said bridge.

2. A watch according to claim 1, wherein said gear train includes a rotor connected to said motor and mounted in said first opening in said carrier plate, said rotor being rotatably mounted to said base plate and said bridge; said motor including a motor coil and stator laminations located on opposite sides of said rotor; said first pocket including indentations shaped in conformance with the outer configurations of said motor coil and stator laminations for receiving said motor coil and said laminations.

3. A watch according to claim 2, including a pair of fasteners securing said motor coil and stator laminations to said base plate.

4. A watch according to claim 1, including a hand adjusting shaft and a hand adjusting gear mounted for rotation with said shaft, said carrier plate including a bore extending radially within the plane of said carrier plate for receiving said hand adjusting shaft and an indentation for receiving said hand adjusting gear; a date ring being provided, a date ring adjusting gear being mounted on said adjusting shaft and received in an opening in said carrier plate.

5. A watch according to claim 1, wherein said gear train includes a minutes gear for driving the minutes hand; said carrier plate includes a central bore aligned axially with a central bearing bore in said base plate and with a bearing bore in said bridge; said minutes gear being mounted on a shaft, said shaft being rotatably supported in said bearing bores.

6. A watch according to claim 1, wherein said carrier plate includes an indentation for receiving a battery; said indentation including a wall to separate said indentation from said base plate, and also including cavities for receiving contact lugs to electrically connect the battery with the electronic block and to hold the battery within the battery indentation.

7. A watch according to claim 6 wherein said electronic block unit includes a plate, at least two fasteners connecting said plate to said carrier plate, one of said fasteners also securing to said carrier plate the one of said contact lugs which interconnects a negative battery terminal and an inlet terminal of the electronic block.

8. A watch according to claim 1 wherein said carrier plate comprises a temperature resistant and dimensionally stable plastic material.

9. A watch according to claim 1, wherein said carrier plate includes a plurality of holding claws integral about the periphery thereof for securing said carrier plate, base plate, and bridge within a watch housing.

10. A watch according to claim 1, wherein said pillars each comprise a fixing bolt attached to said base plate and received in a bore of said carrier plate and fastener means for securing said fixing bolt to said bridge; and there being further provided a plurality of fixing pins integral with said carrier plate and engageable within corresponding bores in said base plate.

11. A watch according to claim 10 wherein said fixing bolt is held by an interference fit within its bore of the carrier plate.

* * * * *